United States Patent [19]

Lavering

[11] 3,970,883

[45] July 20, 1976

[54] ARC LAMP WITH MOVABLE ELECTRODE

[75] Inventor: Gordon R. Lavering, Belmont, Calif.

[73] Assignee: Varian Associates, Palo Alto, Calif.

[22] Filed: Apr. 7, 1975

[21] Appl. No.: 565,893

[52] U.S. Cl. ..... 313/39; 313/40; 313/42; 313/46; 313/146; 313/152

[51] Int. Cl.[2] ..... H01J 61/52

[58] Field of Search ..... 313/146, 152, 39, 40, 313/42, 46

[56] References Cited

UNITED STATES PATENTS

| | | | |
|---|---|---|---|
| 979,277 | 12/1910 | DeForest | 315/243 |
| 2,127,757 | 8/1938 | Saracco | 176/121 |
| 2,545,345 | 3/1951 | Deri | 313/152 |
| 2,703,374 | 3/1955 | Fruengel | 313/149 |
| 3,529,209 | 9/1970 | Lienhard et al. | 315/327 |
| 3,555,339 | 1/1971 | Peacher et al. | 313/152 |
| 3,626,230 | 12/1971 | Stewart | 313/46 |
| 3,644,769 | 2/1972 | Kennedy | 313/46 |
| 3,876,908 | 4/1975 | Chan | 313/152 X |

*Primary Examiner*—R. V. Rolinec
*Assistant Examiner*—Darwin R. Hostetter
*Attorney, Agent, or Firm*—Stanley Z. Cole; Leon F. Herbert; John J. Morrissey

[57] ABSTRACT

The heat-transfer capability of a movable-electrode gas-filled arc lamp is optimized. In the preferred embodiment, the movable electrode is the anode which is mounted at the base of the lamp coaxialy with and spaced apart from the cathode. Low-voltage starting of the lamp is provided by solenoid means for moving the anode briefly into contact with the cathode and then withdrawing the anode from contact with the cathode so that a difference of electrical potential develops between the cathode and the anode, which is sufficient to ionize the gas in the gap formed therebetween. The arc thereby generated in the gap follows the withdrawing anode to its fully spaced-apart position with respect to the cathode. A heat sink member is disposed within the gas-filled envelope at the base of the lamp, and a metal collar is affixed to and surrounds the movable anode. The collar provides thermally conductive contact with the heat sink member when the anode is in its fully spaced-apart position with respect to the cathode. The thermal impedance through the collar to the heat sink member is less than the thermal impedance through any other path from the anode.

15 Claims, 5 Drawing Figures

ARC LAMP WITH MOVABLE ELECTRODE

BACKGROUND OF THE INVENTION

1. Field of the Invention:

This invention is a further development in the field of movable-electrode arc lamps. In particular, the heat transfer capability of such an arc lamp is optimized.

2. Description of the Prior Art:

Movable-electrode arc lamps capable of starting and running from a single low-voltage power supply are known. For example, see the embodiments described in U.S. Pat. No. 3,876,908 to Edwin T. Chan, assigned to Varian Associates.

In an arc lamp, only about 14% to 16% of the electrical energy transmitted to the lamp is converted into visible light. The remainder is converted to heat, which must be removed from the lamp in order to prevent destruction of the lamp components. The more efficient the heat-transfer capability of the lamp is, the longer will be the expected operating life of the lamp.

SUMMARY OF THE INVENTION

This invention optimizes the heat-transfer capability of a two-electrode arc lamp, one electrode being stationary and the other being movable with respect to the stationary electrode. The two electrodes are mounted within a gas-filled envelope in such a way that during operation of the lamp the electrodes are spaced apart such that the arc formed in the gap therebetween lies at or near the focus of a reflector. The reflector converges the light from the arc into a beam for transmission out of the envelope through an optical window. For maximum optical efficiency, the brightest spot of the arc, or in practical effect the tip of the cathode, is precisely positioned with respect to the focus of the reflector. In order to minimize changes in the precise positioning of the tip of the cathode relative to the focus of the reflector as the result of heat cycling of the lamp during operation, it is advantageous for the cathode to be stationarily mounted and for the anode to be movably mounted relative to the stationary cathode.

In the preferred embodiment of this invention, the cathode and anode are coaxially disposed. Low-voltage starting of the lamp is provided by solenoid means for movng the anode into contact with the cathode and then for withdrawing the anode from contact with the cathode so that a difference of electrical potential develops between the electrodes. This difference of potential is sufficient to ionize the gas in the gap between the electrodes, thereby generating an arc. As the anode is withdrawn from contact with the cathode, the arc follows the anode.

A particular feature of this invention is the provision of a relatively massive heat sink member at the base of the lamp within the gas-filled envelope, and the provision of a metal collar affixed to and surrounding the movable electrode. The collar has a mating surface which provides thermally conductive contact with the heat sink member when the movable electrode is in its fully spaced-apart position with respect to the stationary electrode. The collar is affixed to the movable electrode in such a way that the thermal impedance of the heat transfer path from the movable electrode through the collar to the heat sink member is less than the thermal impedance of any other heat transfer path from the movable electrode. It has been found that in an arc lamp the anode runs significantly hotter than the cathode, typically about 50% hotter, due mainly to the effect of electron bombardment of the anode. Thus, from a heat transfer standpoint, it is advantageous for the movable electrode to be the anode rather than the cathode because there is more heat to be removed from the anode than from the cathode. In general, therefore, the heat-transfer collar of this invention would be affixed to the anode. In a particular case, however, where for example optical design considerations might dictate a preference for a rear-mounted movable cathode, the heat-transfer collar of this invention could be affixed to the cathode.

The function of the heat-transfer collar of this invention is to provide a low thermal-impedance heat-transfer path. Thus, the collar would typically be made of copper. Since copper is a relatively malleable metal, a succession of impacts of the collar against the heat sink member during the use cycle of the lamp could result in a bending of the collar. In order to render the collar more rigid and therefore less subject to bending as the result of repeated contacts with the heat sink member, it is advantageous to provide a layer of Kovar alloy on the forward surface of the collar (i.e., on the surface not in contact with the heat sink member).

It is an object of this invention to optimize the heat-transfer capability of a movable-electrode arc lamp.

In particular, it is an object of this invention to facilitate the transfer of heat from a movable electrode in an arc lamp to a heat dissipating medium located externally of the lamp.

More specifically, it is an object of this invention to provide a heat conductive path from a movable electrode in an arc lamp to an external heat dissipating medium via a stationary heat sink member having a heat transfer surface within the lamp and a metal collar affixed to the movable electrode, the collar having a heat transfer surface which mates with the heat transfer surface of the heat sink member during operation of the lamp.

It is a further object of this invention to provide a low-voltage starting arc lamp comprising a stationary cathode, a movable anode, solenoid means for moving the anode into contact with the cathode and thereupon for withdrawing the anode from contact with the cathode for generating an arc in the resulting gap therebetween, a relatively massive heat sink member, and a metal collar affixed to the movable anode in such a way as to provide thermally conductive contact between the collar and the heat sink member when the anode is withdrawn to its fully spaced-apart position with respect to the stationary cathode.

Another object of this invention is to provide a heat transfer path from a movable electrode in an arc lamp via a metal collar affixed to the movable electrode to a heat dissipating medium located externally of the lamp, which heat transfer path has a lower thermal impedance than any other heat transfer path from the movable electrode.

A further object of this invention is to provide a structurally reinforced heat-transfer collar affixed to a movable arc lamp electrode, whereby the heat-transfer collar provides a low-impedance heat conductive path from the movable electrode to a heat sink member while being structurally resistant to mechanical bending or yielding despite repeated impacting upon the heat sink member.

In particular, it is an object of this invention to provide a copper heat-transfer collar on a movable arc lamp electrode, where the collar is structurally reinforced by a layer of Kovar alloy disposed on a surface of the collar other than a conductive heat-transfer surface.

Other features and advantages of this invention will become apparent upon a reading of the following specification in conjunction with the accompanying drawing.

DESCRIPTION OF THE PREFERRED EMBODIMENTS

Figure 1:
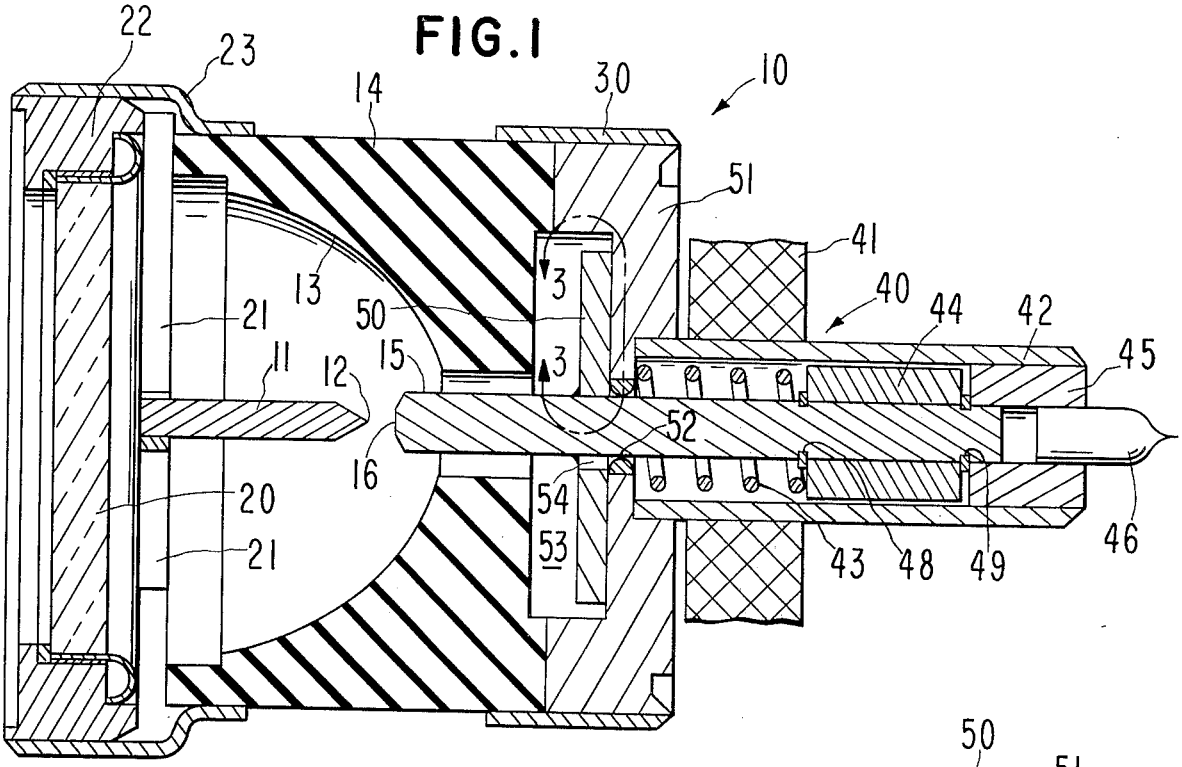
FIG. 1 is a cross-sectional view of an arc lamp according to this invention, with the movable electrode in fully spaced-apart position with respect to the stationary electrode.

The arc lamp 10 shown in cross-sectional view in FIG. 1 comprises a gas-filled hermetically sealed envelope, typically containing xenon gas. An elongate metal cathode 11 is fixedly mounted within the envelope so that the cathode tip 12 maintains a fixed position relative to a reflective surface 13 formed on a ceramic insulating member 14. The insulating member 14 serves to electrically isolate the cathode 11 from an anode 15 when a difference of electrical potential is applied between the cathode and the anode.

In an arc lamp, the brightest spot of the arc is located closely adjacent the tip of the cathode. Therefore, to maximize optical efficiency, it is advantageous to design the reflective surface 13 as a quadratic surface and to locate the tip 12 of the electrode 11 at a fixed focal position with respect to the surface 13. Typically, the surface 13 is ellipsoidal and the cathode tip 12 is located substantially at one of the foci of the ellipsoid. In a more sophisticated embodiment, the surface 13 might comprise a series ellipsoidal segments all perpendicular to the same major axis with adjacent segments being faired to provide a smooth overall surface. In such a sophisticated embodiment, all ellipsoidal segments would have a common external focus lying outside the lamp, but the internal foci of the consecutive segments would lie consecutively along a line joining the cathode tip 12 and the opposing face 16 of the anode 15. In this way, every point along the arc between the electrodes would lie at the focus of an ellipsoidal surface so that all the light in the arc could be brought to a single focus externally of the lamp.

Whatever the configuration of the reflecting surface 13 is, the light generated in the arc gap between the electrodes 11 and 15 is reflected out of the lamp through an optical window 20. As shown in FIG. 1, the cathode 11 is mounted on supporting struts 21, which are brazed to a ring 22, which ring is itself brazed, welded or otherwise attached to a surrounding forward annular metal structure 23. The forward annular structure 23 thereby rigidly supports not only the cathode mounting members 22 and 21 but also the window 20 and its mounting members (unnumbered).

The ceramic insulating member 14 is of generally cylindrical configuration, and is bonded by known ceramic-to-metal sealing techniques to the forward annular structure 23 at one end and to a rear annular metal structure 30 at the other end. The reflecting surface 13 is formed on an internal concavity of the insulating member 14, and is generally symmetric about the cylindrical axis thereof. Typically, the reflecting surface 13 comprises a reflective metal coating deposited on the concavity of the insulating member 14 by a vapor deposition or sputtering process. There is no contact between the metallic reflecting surface 13 and the metallic annular end structures 23 and 30, so that electrical isolation between the end structures 23 and 30 can be maintained.

Figure 2:
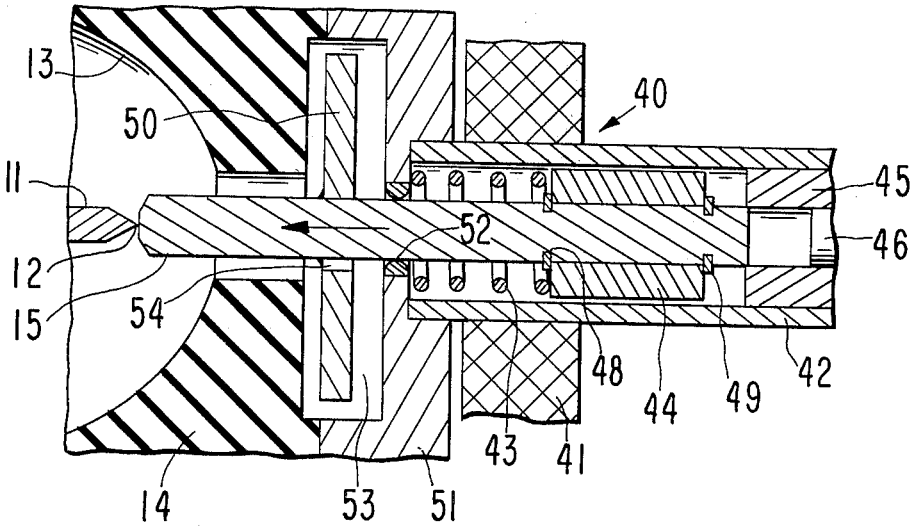
FIG. 2 is a fragmentary cross-sectional view of the arc lamp of FIG. 1, with the movable electrode in contact with the stationary electrode.

The electrodes 11 and 15 are mounted coaxially with respect to each other and with respect to the insulating member 14. The rear electrode 15 is slidably mounted for motion back nd forth between a first position of maximum separation from the forward electrode 11 as shown in FIG. 1, and a second position in contact with the forward electrode 11 as shown in FIG. 2. The present invention is concerned with optimizing the removal of heat from the rear electrode 15 during operation of the lamp. In the usual case, as discussed above, optical efficiency dictates the desirability of mounting the cathode as the forward electrode 11. However, in any particular case where a rear-mounted movable cathode may be desirable, the discussion hereinafter with respect to means for providing heat removal from the rear electrode 15 shall be deemed applicable to the rear electrode simply as a hot mechanical structure regardless of whether the rear electrode is functioning electrically as an anode or a cathode.

The lamp 10 shown in FIGS. 1 and 2 is designed for low-voltage starting from a direct current source such as a 24-volt power supply. To initiate an arc between the electrodes 11 and 15, a solenoid 40 is energized to drive the movable rear-mounted anode 15 from the resting first position of maximum separation from the stationary forward-mounted cathode 11, as shown in FIG. 1, to the energized second position in contact with the cathode tip 12, as shown in FIG. 2. when the solenoid 40 is deenergized, the anode 15 is thereby caused to withdraw from contact with the cathode tip 12 and to return to the first resting position. The separation of the anode 15 from the cathode 11 causes a voltage many times higher than that provided by the power supply to develop between the two electrodes. This voltage is sufficient to ionize the gas in the gap formed between the electrodes, thereby generating an arc in the gap. The arc follows the withdrawing anode 15 as the anode approaches its first resting position, whereupon a stable arc can thereafter be maintained in the lamp at the low-voltage provided by the power supply. An electric circuit for starting an arc lamp of the kind shown in FIG. 1 from a low-voltage power supply is disclosed in the above-mentioned U.S. Pat. No. 3,876,908. Typically, for safety reasons, the forward electrode 11 is operated at ground potential and the rear electrode 15 is operated at a low potential as of 24 voltage above ground potential.

As shown in FIGS. 1 and 2, the solenoid 40 comprises a coil 41 surrounding a cylindrical housing structure 42, which encloses a spring 43 and a ferromagnetic solenoid armature 44 that is affixed to the elongate anode 15. When the solenoid 40 is energized, the housing structure 42 guides the translatory motion of the armature 44 (and hence also the motion of the attached anode 15) forward against the restraining force of the spring 43 until the forward face 16 of the anode 15 comes into contact with the tip 12 of the anode 11. When the solenoid 40 is subsequently deenergized, the mechanicl bias of the spring 43 forces the armature 44 rearward until the attached anode 15 reaches a postion of maximum separation from the cathode 11.

The housing structure 42 is hermetically sealed by a metal end plug 45 having pinched-off tubulation 46 protruding therethrough. The hermetically sealed envelope of the lamp 10 is evacuated and is thereafter filled with the ionizable gas through the tubulation 46 before the tubulation is pinched off. In the embodiment shown in FIG. 1, the rear end of the anode 15 is slidingly received in thermally conductive bearing contact with a central bore of the end plug 45. This thermally conductive contact provides a heat-transfer path from the electrode 15 via the end plug 45 to whatever heat sink medium may conveniently be located externally of the lamp in contact with the end plug 45. It has been a characteristic of the prior art to remove heat from a rear-mounted electrode via a heat transfer path leading from the rear portion of the electrode. Thus, the contact between the rear portion of the anode 15 and the end plug 45, which in the embodiment shown in FIG. 1 happens to be a contact which is smooth enough to permit sliding of the electrode during start-up, provides a heat transfer path that conforms to the prior art. It is a purpose of this invention, however, to provide a shunt heat transfer path leading from the forward portion of the anode 15. The heat transfer path of this invention provides for better heat conduction that was possible with the prior art in terms of calories per unit time being conducted away from the rear-mounted electrode. The heat generated in the anode 15 originates in the arc at the forward face 16 thereof, and travels by conduction within the anode. According to prior art heat transfer techniques, the heat would travel throughout the length of the anode 15 before being conducted away to an external heat sink via a rear heat conducting member such as the end plug 45. The anode of an arc lamp is typically made of tungsten, which has a rather poor thermal conductivity in comparison with that of copper. The rear heat conducting member, such as the end plug 45, would typically be made of copper which has a relatively high thermal conductivity. With prior art heat transfer techniques, the heat transfer path would necessarily include a major portion, if not the entire length, of the high thermal-impedance tungsten anode.

In order to achieve movability for the anode 15, the iron solenoid armature 44 is affixed thereto. In order that the limits of forward and return motion of the anode 15 be precisely repeatable with each start-up of the lamp 10, it is necessary that the solenoid armature 44 be rigidly affixed to the anode 15. In the embodiment shown in FIG. 1, the armature 44 is a hollow cylindrical structure whose inside diameter corresponds to the outside diameter of the anode 15 in such a way that the armature fits tightly over the anode. The over-fitting position of the armature 44 on the anode 15 is rigidly fixed by tempered steel C-rings 48 and 49, which lock into place in precisely positioned C-ring receptor groves on the anode 15. The iron armature 44 is in mechanical contact with the anode 15, but there is no direct conductive heat transfer path through the armature 44 to an external heat sink. Consequently, during operation of a moving-electrode arc lamp where the moving electrode is cooled only by prior art heat-transfer techniques, the attached iron solenoid armature would tend to accumulate heat energy. Similarly, the solenoid spring in contact with the forward end of the armature would likewise tend to accumulate heat energy by conduction from the armature. The accumulation of heat energy in the armature and spring would be relieved only by radiation and by the rather limited heat transfer path that may exist from the spring to a surrounding housing structure. Thermal expansion of the spring and/or of the armature would tend to lessen the precision with which the limits of the forward and return motion of the anode can be controlled. In a case of extreme heat build-up in the armature, thermal expansion might cause jamming of the armature within its housing, thereby precluding repeated on-and-off cycling of the lamp while the moving electrode is hot.

It is a specific feature of this invention that the heat energy which travels conductively through the anode 15 from the forward face 16 thereof finds a lower thermal-impedance path to an external heat sink through a shunt heat-transfer collar 50 that is affixed to the forward portion of the anode 15 than through the entire length of the anode 15. The heat-transfer collar 50 is a relatively massive piece of metal of high thermal conductivity, such as copper. The collar 50 is affixed to the anode 15 forward of the surrounding solenoid spring 43 and armature 44. At the base of the lamp 10, to the rear of the ceramic insulating member 14, a massive hollow cylindrical metal heat sink member 51 is located. The heat sink member 51 is likewise of high thermal conductivity, such as copper. The tungsten anode 15 is disposed coaxially with respect to the heat sink member 51, and is guided in its translational motion by a bearing surface 52 of the heat sink member 51. It has been found that in the usual case adequate support for the anode 15 can be provided where the bearing surface 52 is of the same copper material as the bulk of the heat sink member 51, with a 0.005-inch clearance between the bearing surface 52 and the anode 15 when the components are at room temperature being sufficient to assure a sliding fit between these components when they reach temperatures in the region of the operating temperature of the lamp. For particular purposes, a special bearing material such as a stainless steel ring could be brazed to the heat sink member 51 to provide the bearing surface 52. In like manner, for particular purposes, a stainless steel bearing surface could be provided on the internal surface of the end plug 45.

The annular metal sealing structure 30 provides a hermetic seal between the ceramic insulating member 14 and the copper heat sink member 51. The insulating member 14 and the heat sink member 51, when mated, form a cavity 53 within which the collar 50 is housed. When the anode 15 is in its rearmost position, i.e., when the solenoid 40 is unenergized so that the anode 15 is in its fully spaced-apart position with respect to the tip 12 of the cathode 11, a surface of the collar 50 is in thermally-conductive contact with the heat sink member 51. Good mechanical contact is provided because of the mechanical bias of the spring 43. As shown in FIG. 1, the coils of the spring 43 coaxially surround the anode 15. The rear end of the spring 43 abuts the armature 44 which is rigidly affixed to the anode 15, and the forward end of the spring 43 abuts the stationary base of the lamp 10. The collar 50 is located on the anode 15 such that the mechanical bias of the spring 43 exerts a force on the armature 44 which maintains the anode in position such that firm mechanical contact is maintained between the collar 50 and the heat sink member 51. In the embodiment shown in FIG. 1, the base of the lamp 10 is the massive heat sink member 51, and the spring 43 abuts the heat sink member 51. Thus, the heat sink member 51 also serves, in effect, as part of the housing for the solenoid spring. It is noted that localized heat transfer from the spring 43 through the heat sink member 51 is thereby provided, although the spring 43 never accumulates as much heat as it would otherwise have accumulated with prior art heat-transfer techniques because of the low-impedance heat shunt provided by the collar 50 of this invention.

The collar 50 is affixed to the movable electrode 15 as by brazing. Since the function of the collar 50 is to make thermally conductive contact with the heat sink member 51, it is desirable to provide as large an area of contact between the collar 50 and the heat sink member 51 as possible. It is also desirable to make the heat sink member 51 as massive as possible within the design limitations of the lamp, in order to provide as rapid heat transfer as possible to an external heat sink medium. It is anticipated that in most applications, adequate heat dissipation from the heat sink member 51 to the surrounding atmosphere would be provided with the design shown in FIGS. 1 and 2. In special cases where more rapid heat dissipation to the surrounding atmosphere would be desirable, fin or vane structures of known configuration could be affixed in thermally conductive contact to the heat sink member 51. In certain applications, a water jacket or a circulating-liquid technique could be used to provide conductive heat transfer away from the heat sink member 51.

Figure 3:
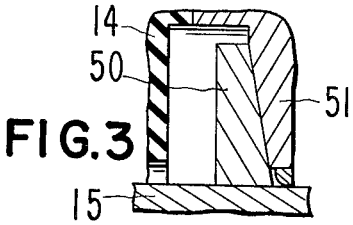
FIG. 3 is a fragmentary view of the portion of the arc lamp delineated by line 3—3 in FIG. 1, showing an alternative embodiment of the heat-transfer collar.

In FIGS. 1 and 2, the heat-transfer collar 50 is configured as an annular plate or disk surrounding the anode 15, with surfaces perpendicular to the axis of the anode 15. A hole 54 may be drilled through the collar 50 to provide a dashpot effect in order to damp the return motion of the anode 15 in response to the deenergization of the solenoid 40. The rearward-facing surface of the collar 50 mates with a similarly configured forward-facing surface on the heat sink member 51. In order to provide a larger contact area between the collar 50 and the heat sink member 51, the rearward-facing surface of the collar 50 could be conical as shown in FIG. 3. In this embodiment, the heat sink member 51 would have a forward-facing concave surface portion configured to mate with the conical rearward-facing surface of the collar 50.

Figure 4:
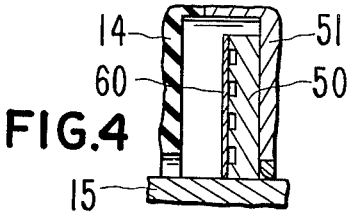
FIG. 4 shows another alternative embodiment of the heat-transfer collar shown in FIG. 1.
Figure 5:
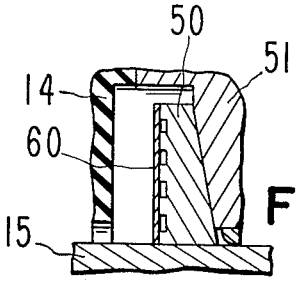
FIG. 5 shows yet another embodiment of the heat-transfer collar shown in FIG. 1.

The most practicable metal for the heat-transfer collar 50 is copper, which is a relatively soft metal. Repeated contact between the collar 50 and the heat sink member 51 as the result of the deenergization of the solenoid 40 could result in bending or yielding of the collar 50. In order to provide mechanical strength against such bending or yielding, it is possible to provide a cladding 60 of a relatively unyielding metal, such a Kovar alloy, on the forward-facing (i.e., non-transfer) surface of the collar 50, as shown in FIGS. 4 and 5 for different configurations of the collar. The Kovar alloy could be clad onto the copper by brazing, using for example a copper-silver brazing paste. The embodiments shown in FIGS. 4 and 5 indicate a waffled pattern for the copper surface which mates with the Kovar cladding surface. In a particular embodiment, the lands of the copper heat transfer surface might be about ⅛-inch wide, with the grooves being 1/16-inch deep. The purpose of this waffled pattern is to facilitate the bonding of the Kovar alloy to the copper. More specifically, during the cooling of the cladded heat-transfer collar structure following the brazing operation, the volume of copper remaining between any two grooves can flow into the grooves, thereby relieving the stress that results because of the difference between the respective rates of thermal contraction for the Kovar alloy and the copper.

Since changes could be made in particular details of the embodiments of the invention disclosed herein without departing from the scope of the invention, it is intended that the above description and accompanying drawing be interpreted as illustrative only and not as limiting.

What is claimed is:

1. An arc lamp comprising a stationary electrode and an elongate movable electrode, means for moving said movable electrode between a first position in which an arc tip thereof is in contact with said stationary electrode and a retracted fixed position in which said arc tip of said movable electrode is spaced apart from said stationary electrode to form an arc gap between the movable electrode and the stationary electrode, said moving means comprising a solenoid armature on said movable electrode, and means for providing a shunt heat-transfer path from said movable electrode at a location between the arc tip of said movable electrode and said armature, the thermal impedance of said shunt heat-transfer path being lower than the thermal impedance from said arc tip through the length of said electrode.

2. The arc lamp of claim 1 wherein said movable electrode is an anode.

3. The arc lamp of claim 1 wherein said means for providing said shunt heat-transfer path comprises a heat-transfer collar affixed to said movable electrode.

4. The arc lamp of claim 3 wherein said heat-transfer collar is affixed to said movable electrode at a place intermediate said arc tip and said armature.

5. The arc lamp of claim 3 wherein said means for providing said shunt heat-transfer path further comprises a metal heat sink member, one surface of said heat sink member being configured to permit thermally conductive contact with said collar and another surface of said heat sink member being exposed to an environment external to said lamp.

6. The arc lamp of claim 5 wherein the surface of said heat sink member configured to permit thermally conductive contact with said collar is generally perpendicular to the long axis of said elongate electrode.

7. The arc lamp of claim 5 wherein the surface of said heat sink member congigured to permit thermally conductive contact with said collar is nonperpendicular to the long axis of said elongate electrode.

8. The arc lamp of claim 5 wherein said heat-transfer collar is made of copper.

9. The arc lamp of claim 8 wherein said heat-transfer collar further comprises a non-copper structural member to provide strength against bending.

10. The arc lamp of claim 9 wherein said non-copper structural member comprises a layer of Kovar alloy disposed on a surface of said collar that does not come into contact with said heat sink member.

11. An arc lamp comprising a sealed envelope having a light-transmitting window at one end thereof, a first electrode in said envelope, an elongated second electrode in said envelope and movable toward and away from said first electrode, a thermally conductive heat sink member having an aperture through which said second electrode moves toward and away from said first electrode, a thermally conductive collar on said second electrode between said heat sink member and the end of said second electrode which is nearest said first electrode, the diameter of said collar being larger than said aperture whereby said collar abuts said heat sink member outwardly of the periphery of said aperture when said second electrode is moved away from said first electrode, said heat sink member being of a material which is at least as thermally conductive as the material of said second electrode, and means for moving said second electrode from a first position in which said end of said second electrode contacts said first electrode and a second position in which said collar abuts said heat sink member and said electrodes form an arc gap therebetween.

12. The arc lamp of claim 11 in which said collar and said heat sink member are both made of material having a higher thermal conductivity than the material of said second electrode.

13. The arc lamp of claim 11 in which the area of contact between said collar and said heat sink member is larger than the cross-sectional area of said second electrode.

14. An arc lamp comprising a sealed envelope, a first electrode in said envelope, an elongated second electrode in said envelope and movable toward and away from said first electrode, a thermally conductive heat sink member having an aperture therein through which said second electrode moves toward and away from said first electrode, a thermally conductive collar on said second electrode between said heat sink member and the end of said second electrode which is nearest said first electrode, the diameter of said collar being larger than said aperture whereby said collar abuts said heat sink member outwardly of the periphery of said aperture when said second electrode is moved away from said first electrode, said heat sink member being of a material which is at least as thermally conductive as said second electrode, means for moving said second electrode from a first position in which said end of said second electrode contacts said first electrode and a second position in which said collar abuts said heat sink member and said electrodes form an arc gap therebetween, said moving means including a solenoid armature on said second electrode, and said armature being located on said second electrode a position more distant from said end of the second electrode then the position of said collar.

15. The arc lamp of claim 14 in which said collar and said heat sink member are both made of a material having a higher thermal conductivity than the material of said second electrode.

* * * * *

UNITED STATES PATENT AND TRADEMARK OFFICE

CERTIFICATE OF CORRECTION

PATENT NO. : 3,970,883

DATED : July 20, 1976

INVENTOR(S) : Gordon R. Lavering

It is certified that error appears in the above-identified patent and that said Letters Patent are hereby corrected as shown below:

In the Abstract, line 4, change "coaxialy" to -- coaxially --.

Column 5, line 35, change "that" to -- than --.

Column 5, line 67, change "groves" to -- grooves --.

Column 8, line 57, change "congigured" to -- configured --.

Column 10, line 23, insert the word -- at -- between "electrode" and "a".

Column 10, line 24, change "then" to -- than --.

Signed and Sealed this

Twelfth Day of October 1976

[SEAL]

*Attest:*

RUTH C. MASON
*Attesting Officer*

C. MARSHALL DANN
*Commissioner of Patents and Trademarks*